US010424880B2

(12) United States Patent
Yoshiura et al.

(10) Patent No.: US 10,424,880 B2
(45) Date of Patent: Sep. 24, 2019

(54) SHIELD CONNECTOR AND METHOD FOR CONNECTING SAME

(71) Applicant: SMK Corporation, Tokyo (JP)

(72) Inventors: Yasuo Yoshiura, Kanagawa (JP); Katsuhisa Serizawa, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/011,641

(22) Filed: Jun. 19, 2018

(65) Prior Publication Data

US 2019/0089099 A1 Mar. 21, 2019

(30) Foreign Application Priority Data

Sep. 19, 2017 (JP) ..... 2017-178502

(51) Int. Cl.

| | |
|---|---|
| ***H01R 13/6593*** | (2011.01) |
| ***H01R 13/422*** | (2006.01) |
| ***H01R 13/6581*** | (2011.01) |
| ***H01R 9/03*** | (2006.01) |
| ***H01R 13/502*** | (2006.01) |
| *H01R 13/436* | (2006.01) |

(52) U.S. Cl.

CPC ..... *H01R 13/6593* (2013.01); *H01R 9/038* (2013.01); *H01R 13/4223* (2013.01); *H01R 13/502* (2013.01); *H01R 13/6581* (2013.01); *H01R 13/4367* (2013.01)

(58) Field of Classification Search

CPC ..... H01R 13/6593; H01R 9/038; H01R 13/4223; H01R 13/502; H01R 13/6581; H01R 12/596; H01R 9/032; H01R 13/6592

USPC .. 439/607.41, 98, 99, 607.48, 607.52, 607.5

See application file for complete search history.

(56) References Cited

U.S. PATENT DOCUMENTS

| | | | | |
|---|---|---|---|---|
| 6,080,018 | A * | 6/2000 | Ferrill | H01R 9/035 439/607.47 |
| 6,238,246 | B1 * | 5/2001 | Ferrill | H01R 9/035 439/607.47 |
| 6,929,512 | B2 * | 8/2005 | Lai | H01R 4/48 439/607.27 |
| 7,479,037 | B2 * | 1/2009 | Bernat | H01R 9/037 439/607.41 |
| 7,918,685 | B1 * | 4/2011 | Kruckenberg | H01B 11/00 174/75 C |
| 2013/0288522 | A1 | 10/2013 | Ii | |
| 2015/0333450 | A1 * | 11/2015 | Yamada | H04B 3/28 439/607.05 |

* cited by examiner

*Primary Examiner* — Travis S Chambers

(57) ABSTRACT

A shield connector is formed such that an electrical wire shield portion at an end of an electrical shield wire is removed to expose a plurality of single shield wires; connection terminals are each connected to the conductor at an end of each exposed single shield wire; the connection terminals are held in an inner housing; the inner housing and the single shield wires are sheathed with a shield shell; and an attachment piece integrated with the shield shell is fixedly attached to an end of the electrical shield wire. The shield shell is provided with a connector shield member, and the connector shield member is electrically connected to single wire shield portions of the exposed single shield wires.

8 Claims, 8 Drawing Sheets

SHIELD CONNECTOR AND METHOD FOR CONNECTING SAME

CROSS REFERENCE TO RELATED APPLICATION

The contents of the following Japanese patent application are incorporated herein by reference, Japanese Patent Application No. 2017-178502 filed on Sep. 19, 2017.

FIELD

The present invention relates to a shield connector, which connects a composite cable having a plurality of single shield wires to one electrical shield wire, and a method for connecting the same. In particular, the shield connector can provide impedance matching generally in the entire region of a processed connection portion without an open grounded shield portion of an exposed shield single wire.

BACKGROUND

As illustrated in FIG. 6, a shield connector which connects a composite cable having a plurality of single shield wires to a shield connector is known (Patent Literature 1).

In FIG. 6, an electrical shield wire 10 is configured such that in a connecting portion to a shield connector 11, a sheath portion 18 and a shield foil 21 are removed to expose each of a plurality of single shield wires 20, and furthermore, the conductor of each of the single shield wires 20 is exposed and then connected to a crimp portion 22 of male terminals 12. Each of the male terminals 12 is accommodated in an inner housing 13, and the top portions of the male terminals 12 are inserted into a front holder 14.

The inner housing 13 and the front holder 14, which have been incorporated into one piece, are wrapped in a shield portion 23 of a shield shell 15 and then covered with a shell cover 16. Then, a barrel portion 19 of the shield shell 15 is fixedly crimped to the sheath portion 18 at an end of the electrical shield wire 10. After the shield shell 15 is fixedly swaged to the electrical shield wire 10, then the shield shell 15 is fixedly inserted into an outer housing 17.

CITATION LIST

Patent Literature

Patent Literature 1: Japanese Patent Application Laid-Open No. 2013-229254

SUMMARY

Technical Problem

In the invention disclosed in Patent Literature 1, the plurality of single shield wires 20 exposed by removing the sheath portion 18 and the shield foil 21 from the electrical shield wire 10 and the male terminals 12 are sheathed with the shield shell 15 and the shell cover 16. However, if the single shield wires 20 are like a high-speed wire which is used for high-speed differential transmission, the exposed portion causes an impedance mismatch even when sheathed with the shield shell 15 and the shell cover 16, thus providing deteriorated transmission performance. Thus, in the invention disclosed in Patent Literature 1, it is stated concerning the length of the exposed portion that the shorter, the better.

However, with increasing numbers of single shield wires 20 in the electrical shield wire 10, the workability of connection between the male terminals 12 and a number of single shield wires 20 exposed by removing the sheath portion 18 and the shield foil 21 and assembly with the shield connector 11 limited the shortest length of the exposed portion, thus raising the possibility of causing an impedance mismatch.

It is an object of the present invention to provide a shield connector and a method for connecting the same for a composite electrical shield wire with a plurality of single shield wires shielded with a shield member. The shield connector and the method are configured to prevent as much as possible an impedance mismatch that may result from the connection between a single shield wire and a connection terminal which is performed by removing the shield portion thereof at an end.

Solution to Problem

A shield connector of one aspect of the present invention includes: an electrical shield wire having a plurality of single shield wires exposed by removing an electrical wire shield portion at an end thereof; connection terminals connected to conductors of the exposed respective single shield wires at ends thereof; an inner housing configured to hold the connection terminals; a shield shell configured to sheath the inner housing and the shield single wires; and an attachment piece which is integrated with the shield shell and fixedly attached to the end of the electrical shield wire, wherein the shield connector includes a connector shield member provided to the shield shell and electrically connected to single wire shield portions of the exposed single shield wires.

It is desirable that the position of electrical connection between the connector shield member and the single wire shield portion should be as close as possible to the position at which the conductors of the single shield wires connected at the connection terminals are exposed.

An erected piece of the connector shield member is bonded under pressure and electrically connected to the single wire shield portions of the exposed single shield wires.

By way of example, the electrical shield wire to be employed is configured such that a plurality of high-speed wires and one drain wire are surrounded by an inner shield portion; a plurality of middle-speed wires and two power supply lines are disposed on the outer circumference of the inner shield portion; and the entirety thereof is sheathed with the electrical wire shield portion and a sheath portion.

At least the single wire shield portion configured from a spiral shield 31*c* and a shield portion of a high-speed wire among the plurality of single shield wires which tends to cause an impedance mismatch is provided with the connector shield member that is electrically connected.

The connector shield member that is electrically connected may also be provided to face not only to the plurality of high-speed wires but also to single wire shield portions configured from a spiral shield and a shield portion of the plurality of middle-speed wires.

The plurality of high-speed wires may be configured from differential signal transmission signal lines.

Further provided is a method for connecting a shield connector, the method including: removing an electrical wire shield portion at an end of an electrical shield wire to expose a plurality of single shield wires; connecting each of connection terminals to a conductor at an end of each of the exposed single shield wires; holding the connection terminals in an inner housing; sheathing the inner housing and the single shield wires with a shield shell; and fixedly attaching an attachment piece integrated with the shield shell to the end of the electrical shield wire.

The method is characterized in that the shield shell is provided with a connector shield member; and the connector shield member is pushed against single wire shield portions of the exposed single shield wires for electrical connection by swaging, soldering or sandwiching.

According to the shield connector of a first aspect of the invention, a shield connector includes an electrical shield wire having a plurality of single shield wires exposed by removing an electrical wire shield portion at an end thereof, connection terminals connected to conductors of the exposed respective single shield wires at ends thereof, an inner housing configured to hold the connection terminals, a shield shell configured to sheath the inner housing and the shield single wires, and an attachment piece which is integrated with the shield shell and fixedly attached to the end of the electrical shield wire. In this shield connector, the shield connector is configured to include a connector shield member provided to the shield shell and electrically connected to single wire shield portions of the exposed single shield wires. Thus, even when for connection processing between the single shield wire and the connection terminal, the exposed single shield wire may be elongated for connection processing, impedance matching can be readily implemented without an open grounded shield portion. It is also possible to cover gaps between shield connector parts and provide improved shield properties.

According to a second aspect of the invention, the position of electrical connection between the connector shield member and the single wire shield portion is made as close as possible to the position at which the conductors of the single shield wires connected at the connection terminals are exposed. Thus, this allows the shield portion not to be open grounded with greater reliability and impedance matching to be more easily provided.

According to a third aspect of the invention, an erected piece of the connector shield member is bonded under pressure and electrically connected to the single wire shield portions of the exposed single shield wires. Thus, this simplified structure allows the shield portion not to be open grounded and impedance matching to be easily provided.

According to a fourth aspect of the invention, the electrical shield wire is configured such that high-speed wires configured from a plurality of single shield wires and one drain wire are surrounded by an inner shield portion; middle-speed wires configured from a plurality of single shield wires and two power supply lines are disposed on an outer circumference of the inner shield portion; and an entirety thereof is sheathed with the electrical wire shield portion and the sheath portion. Thus, the electrical shield wire can be used for a composite wire that includes a high-speed wire and a middle-speed wire.

According to a fifth aspect of the invention, the connector shield member that is electrically connected to single wire shield portions of the high-speed wires configured from the plurality of exposed single shield wires is provided to face to the single wire shield portions. Thus, in particular, this is effective for a high-speed electrical shield wire that is subject to an impedance mismatch.

According to a sixth aspect of the invention, the connector shield member that is electrically connected to single wire shield portions of the high-speed wires configured from the plurality of exposed single shield wires and single wire shield portions of middle-speed wires configured from the plurality of exposed single shield wires is provided to face to the single wire shield portions of the high-speed wires and the middle speed wires. Thus, effects for different types of composite electrical shield wires can be provided.

According to a seventh aspect of the invention, the plurality of high-speed wires are configured from differential signal transmission signal lines. Thus, this leads to a faster transmission speed of a signal line and an increased number of signal lines.

According to an eighth aspect of the invention as set forth in claim 8, provided is a method for connecting a shield connector including: removing an electrical wire shield portion at an end of an electrical shield wire to expose a plurality of single shield wires; connecting each of connection terminals to a conductor at an end of each of the exposed single shield wires; holding the connection terminals in an inner housing; sheathing the inner housing and the single shield wires with a shield shell; and fixedly attaching an attachment piece integrated with the shield shell to the end of the electrical shield wire.

In this method, the shield shell is provided with a connector shield member, and the connector shield member is pushed against the single wire shield portions of the exposed single shield wires for electrical connection by swaging, soldering or sandwiching. This makes it possible to select a connection method depending on the purpose such as the ease of processing for connection to connection terminals or the degree of importance of shield properties.

DESCRIPTION OF EMBODIMENTS

Figure 1A:
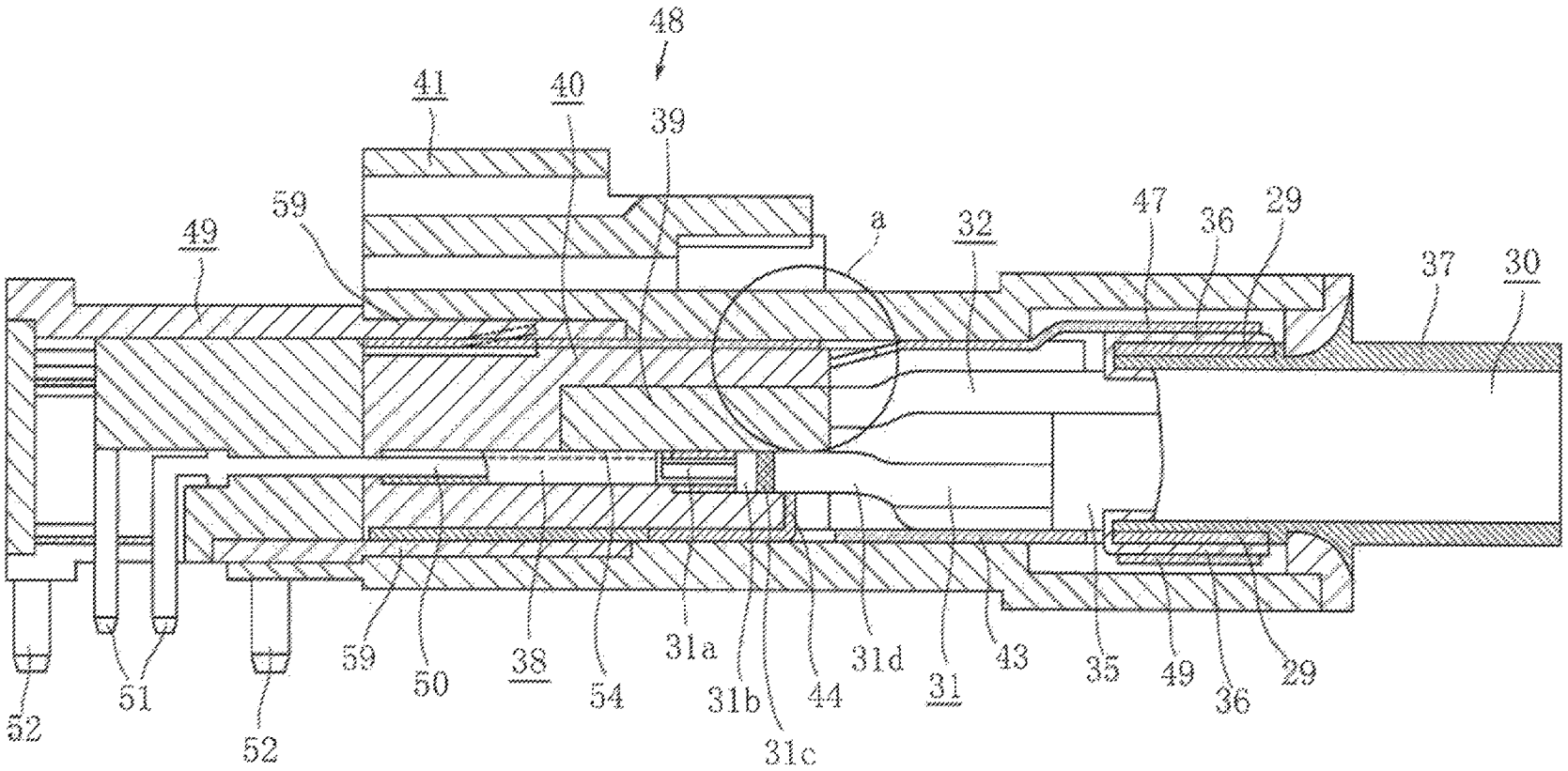
FIG. 1A is a cross-sectional view illustrating a shield connector and a method for connecting the same according to a first embodiment of the present invention.

A shield connector according to an embodiment of the present invention includes an electrical shield wire having a plurality of single shield wires exposed by removing an electrical wire shield portion 36 at an end thereof, connection terminals 38 connected to conductors of the exposed respective single shield wires 31 and/or 32 at ends thereof, an inner housing 39 configured to hold the connection terminals 38, a shield shell 42 configured to sheath the inner housing 39 and the shield single wires, and an attachment piece 47 which is integrated with the shield shell 42 and fixedly attached to the end of the electrical shield wire. The shield connector is configured to include a connector shield member 43 provided to the shield shell 42 and electrically connected to single wire shield portions of the exposed single shield wires.

To improve the properties of the shield connector, it is desirable that the position of electrical connection between the connector shield member 43 and the single wire shield portions should be as close as possible to the position at which the conductors 31*a* and/or 32*a* of the single shield wires 31 and/or 32 connected at the connection terminal 38 are exposed.

To simplify the configuration, erected pieces 44 of the connector shield member 43 are bonded under pressure and electrically connected to the single wire shield portions of the exposed single shield wires 31 and/or 32.

By way of example, the electrical shield wire 30 to be employed is configured such that a plurality of high-speed wires 31 and one drain wire 34 are surrounded by an inner shield portion 35; a plurality of middle-speed wires 32 and two power supply lines 33 are disposed on the outer circumference of the inner shield portion 35; and the entirety thereof is then sheathed with the electrical wire shield portion 36 and a sheath portion 37.

At least the single wire shield portion configured from a spiral shield 31*c* and a shield portion 31*d* of a high-speed wire 31 among the plurality of single shield wires 31 and/or 32, which tends to cause an impedance mismatch, is provided with the connector shield member 43 that is electrically connected thereto.

Furthermore, facing with not only the plurality of high-speed wires 31 but also a single wire shield portion configured from a spiral shield 32*c* and a shield portion 32*d* of the plurality of middle-speed wires 32, the connector shield member 43 that is electrically connected may also be provided.

Furthermore, the plurality of high-speed wires 31 may be configured from differential signal transmission signal lines.

In a method for connecting a shield connector in which an electrical wire shield portion 36 at an end of an electrical shield wire 30 is removed to expose a plurality of single shield wires 31 and/or 32; connection terminals 38 are each connected to a conductor 31*a* and/or 32*a* at an end of each of the exposed single shield wires 31 and/or 32; the connection terminals 38 are held in the inner housing 39; the inner housing 39 and the single shield wires are sheathed with a shield shell 42; and an attachment piece 47 integrated with the shield shell 42 is fixedly attached to the end of the electrical shield wire 30.

In this method, depending on the purpose, it is possible to select a method for providing the shield shell 42 with a connector shield member 43, and then pushing the connector shield member 43 against the single wire shield portions of the exposed single shield wires 31 and/or 32 for electrical connection by swaging, soldering or sandwiching.

[First Embodiment]

With reference to the drawings, a description will now be given of a first embodiment of the present invention.

Figure 2:
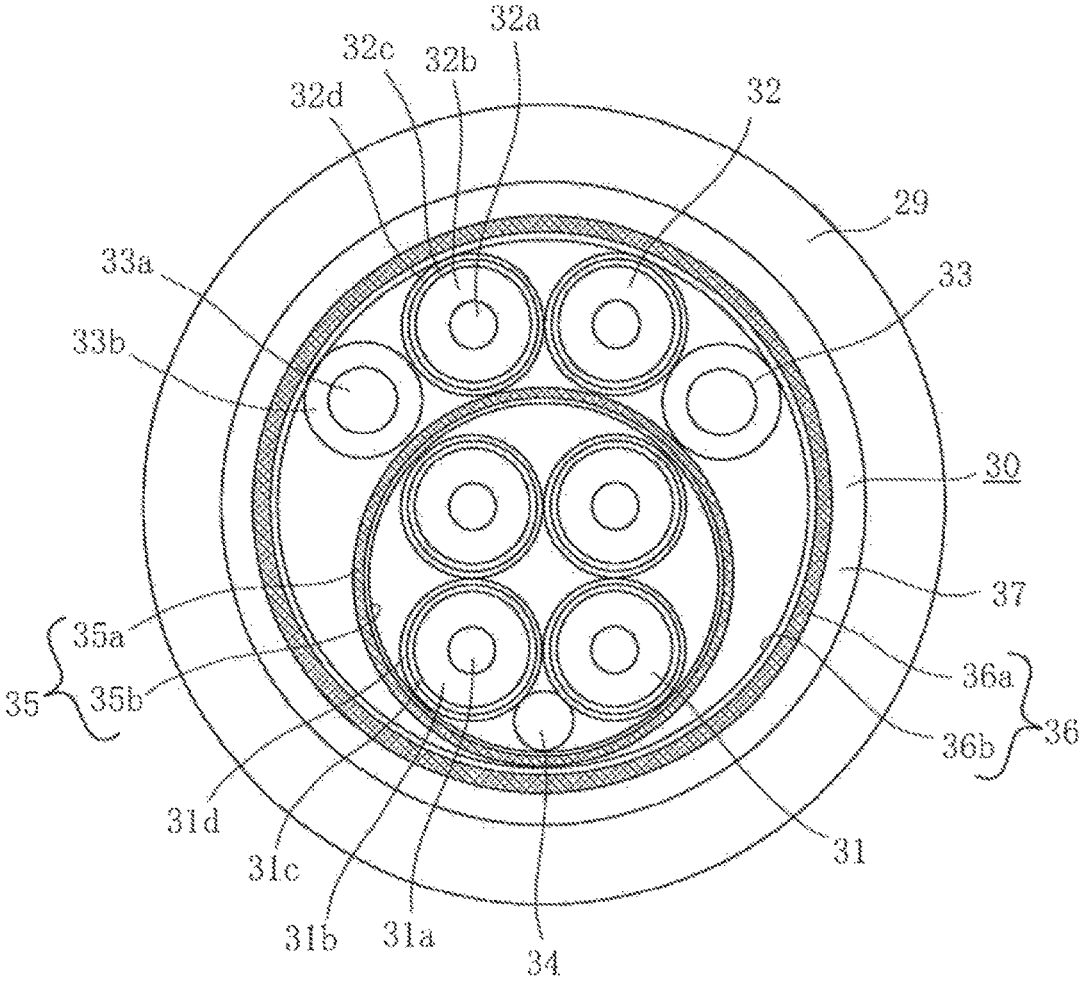
FIG. 2 is an end view illustrating an example of the composite electrical shield wire illustrated in FIG. 1A.

FIG. 2 illustrates an 8-core composite electrical shield wire 30 to be used in the shield connector and the method for connecting the same according to the embodiment(s) of the present invention. The composite electrical shield wire 30 in this example has six single shield wires, four single shield wires 31 of which are a high-speed wire to be used, for example, for transmission of differential signals and two single shield wires 32 of which are a middle-speed wire. This composite electrical shield wire 30 also has two power supply lines 33 and one drain wire 34.

The four high-speed wires 31 each have a center conductor 31*a* sheathed with an insulator 31*b* and further an outer circumference sheathed with a single wire shield portion configured from a spiral shield portion 31*c* and an aluminum tape 31*d*. Likewise, the two middle-speed wires 32 each have a center conductor 32*a* sheathed with an insulator 32*b* and further an outer circumference sheathed with a single wire shield portion configured from a shield portion 32*c* and an aluminum tape 32*d*. The power supply lines 33 each have a center conductor 33*a* sheathed with an insulator 33*b*.

The four high-speed wires 31 are collectively bundled together with one drain wire 34 by an inner shield material 35 configured from an insulation tape 35*a* and an aluminum tape 35*b*. On the outer circumference of these high-speed wires 31 are disposed the two middle-speed wires 32 and the two power supply lines 33. Then, the entirety thereof including those collectively bundled by the inner shield material 35 is sheathed with an outer shield material 36 configured from a braided shield 36*a* and an aluminum tape 36*b*, and further the outer circumference is protected with the sheath portion 37.

Note that the electrical shield wire 30 illustrated as an example had eight cores, but without being limited thereto, may also be greater or less in number than that. Furthermore, the combination of the numbers of high-speed wires and middle-speed wires is not limited to the aforementioned example; the greater the number, the greater the effects of the embodiment(s) of the present invention can be expected.

For connection to the connection terminals 38 of the shield connector according to the embodiment(s) of the present invention, the end of the electrical shield wire 30 is processed in such a manner that part of the sheath portion 37 and the electrical wire shield portion 36 of the electrical shield wire 30 is removed so as to expose the conductors 31*a* of the high-speed wires 31, the conductors 32*a* of the middle-speed wires 32, and the conductors 33*a* of the power supply lines 33. Assuming that the electrical shield wire 30 has a diameter of 6.5 mm, the single wire such as the high-speed wires 31 is exposed about 15 to 20 mm to facilitate connection processing. In order to prevent deterioration of transmission properties due to an impedance mismatch caused by the high-speed wires 31 and the middle-speed wires 32 being exposed, the exposed length is determined depending on the ease of the connection processing.

In this embodiment, the shield portion is removed in such a manner that the insulator 31*b*, the spiral shield portion 31*c*, and the aluminum tape 31*d* are removed so as to expose the conductor 31*a* of the high-speed wire 31 about 2 mm from the top, and then the spiral shield portion 31*c* and the aluminum tape 31*d* are removed about 1 mm from the conductor 31*a* so that the conductor 31*a* will not make a short circuit with the spiral shield portion 31*c* and the aluminum tape 31*d*. Likewise, the middle-speed wires 32 are processed in such a manner that the conductor 32*a* is exposed about 2 mm from the top, and further the spiral shield portion 32*c* and the aluminum tape 32*d* are removed about 1 mm from the conductor 32*a*. Concerning the power supply lines 33, the insulator 33*b* is also removed so that the conductor 33*a* is exposed about 2 mm.

Figure 3A:
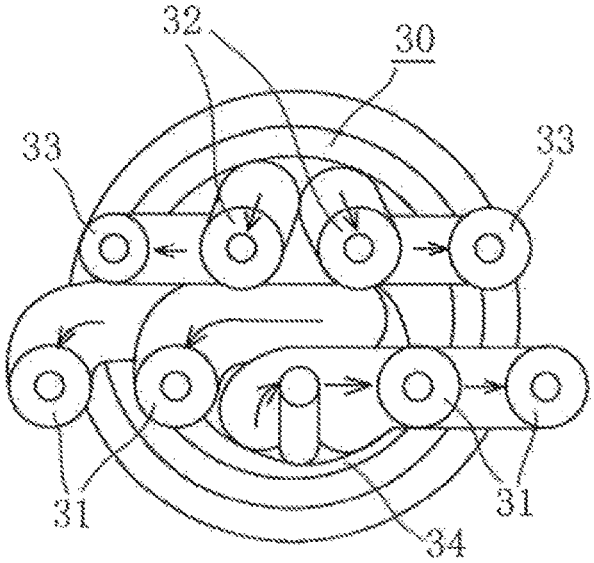
FIG. 3A is a front view illustrating an electrical shield wire arranged for connection to a shield connector and a method for connecting the same according to the embodiment(s) of the present invention.
Figure 3B:
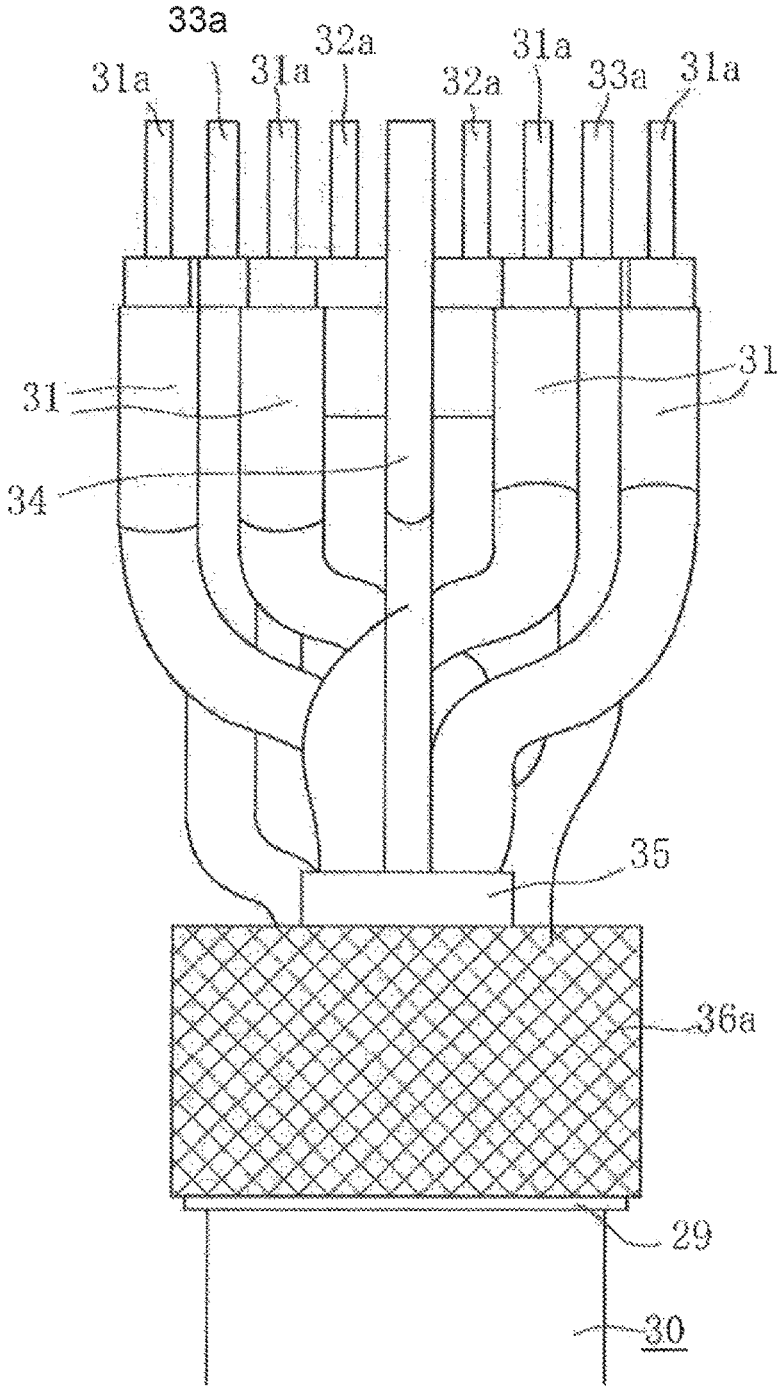
FIG. 3B is a plan view illustrating the electrical shield wire shown in FIG. 3A.

As illustrated in FIGS. 3A and 3B, the electrical shield wire 30 for which the shield portion has been removed in this manner so as to expose the conductor at the top is provided with a reinforcement ring 29 fitted over the end of the electrical shield wire 30. Furthermore, to match pin holes 57 of a cable jack 48, the lower stage is provided with two high-speed wires 31 disposed at predetermined intervals on both sides about the drain wire 34, and the upper stage is provided with two middle-speed wires 32 at the center, and one power supply line 33 is disposed on both sides thereof.

Part of the braided shield 36*a* of the electrical wire shield portion 36 is turned up on the outer circumference of the reinforcement ring 29 fitted over the sheath portion 37 at an end of the electrical shield wire 30.

Figure 4A:
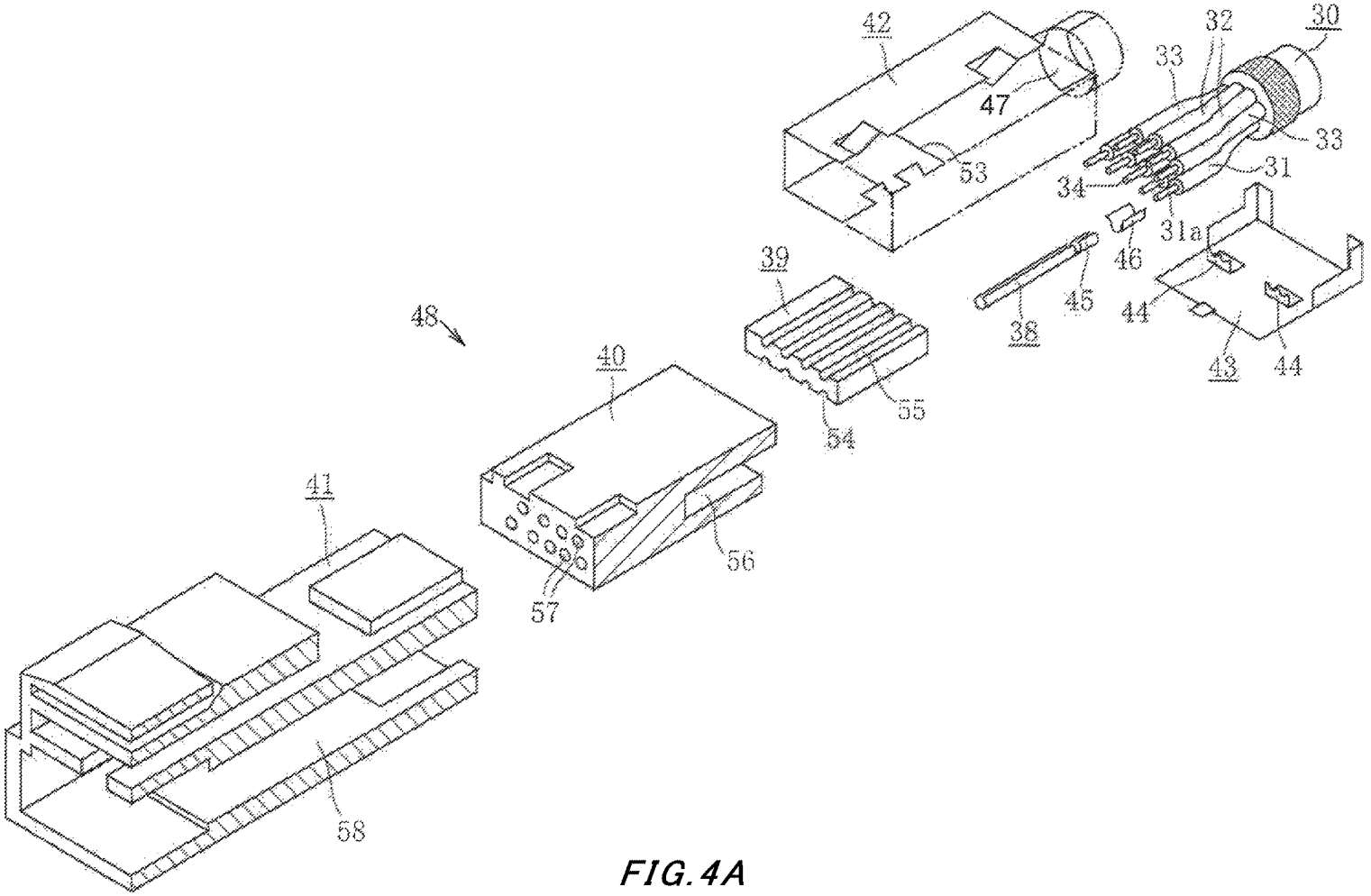
FIG. 4A is an exploded perspective view illustrating a cable jack for the shield connector and the method for connecting the same according to the embodiment(s) of the present invention.
Figure 4B:
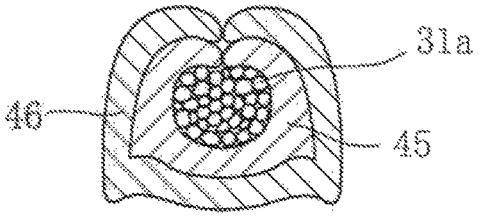
FIG. 4B is a cross-sectional view illustrating the conductor of a single shield wire which is crimped to a crimp portion of a connection terminal integrally with an electrically conductive protective member.
Figure 5:
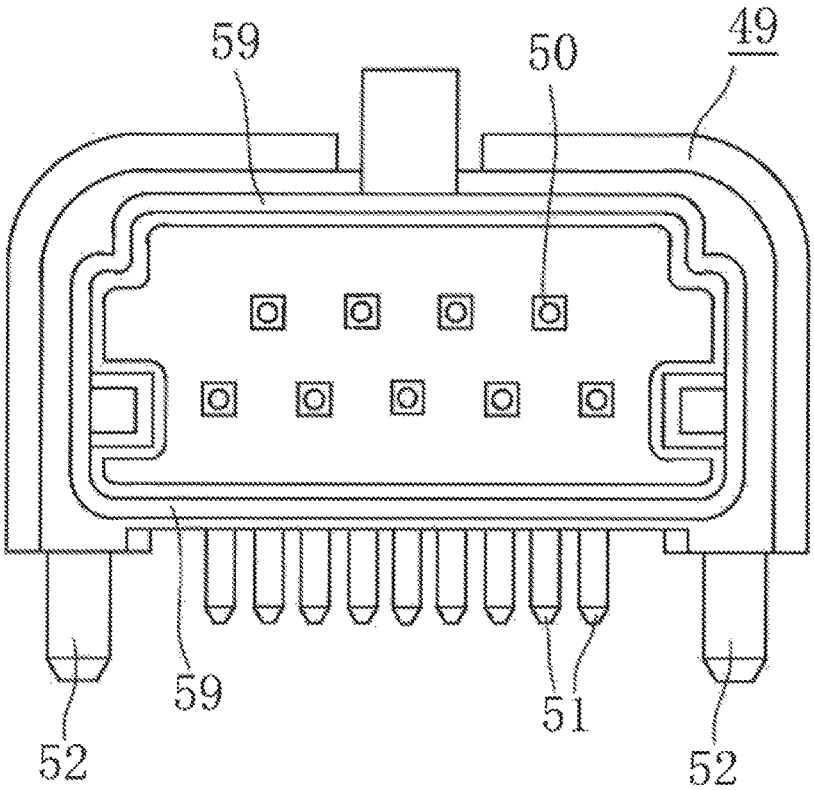
FIG. 5 is a front view illustrating a board-side plug to be connected to the cable jack of the embodiment(s) of the present invention.
Figure 6:
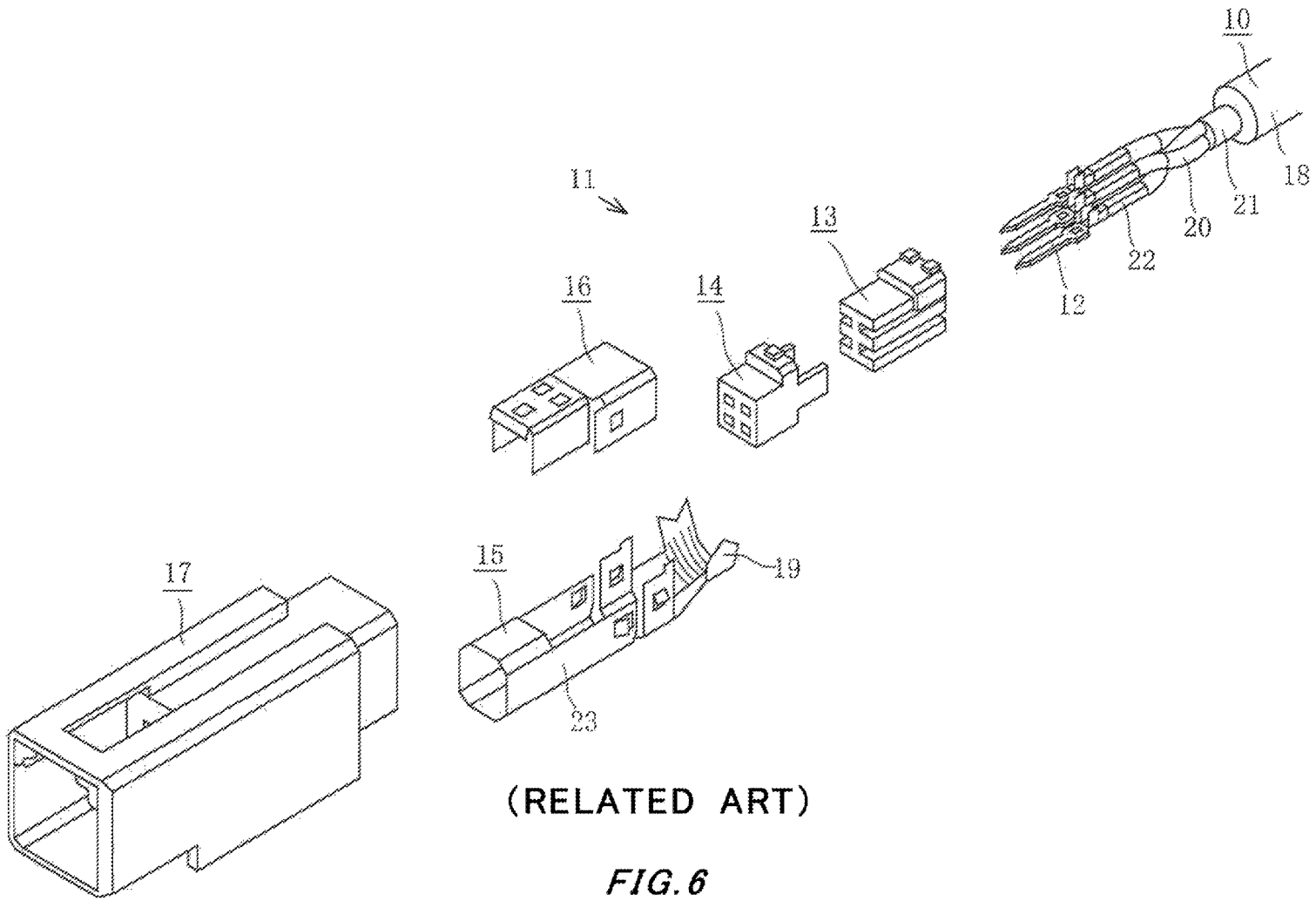
(RELATED ART) FIG. 6
FIG. 6 is an exploded perspective view illustrating a related shield connector and a method for connecting the same.

As illustrated in FIG. 4A, each of the conductor portions 31*a*, 32*a*, and 33*a* of the high-speed wires 31, the middle-speed wires 32, and the power supply lines 33, which are exposed from the electrical shield wire 30, and the drain wire 34 is inserted into a crimp portion 45 of each of the connection terminals 38 with a U-shaped electrically conductive protective member 46 brought into contact therewith from below, and then as illustrated in FIG. 4B, integrally bonded under pressure and connected together. The pressure bonded and connected portions of the total of nine connection terminals 38 which have been bonded under pressure and connected are disposed in lower grooves 54 and upper grooves 55 of the inner housing 39 with the tops of the connection terminals 38 disposed so as to be protruded from the top of the inner housing 39, and then inserted into a front holder 40. Then, as illustrated in FIG. 1A, the projected portions of the connection terminals 38 are received in the pin holes 57 of the front holder 40.

The outside of the front holder 40 into which the inner housing 39 and the connection terminals 38 are fitted is surrounded by a rectangular tube type shield shell 42. The bottom plate of the shield shell 42 is partially notched, and the connector shield member 43 is fitted to the notch 53 from below so as to be electrically connected to the shield shell 42. The connector shield member 43 is provided with the erected pieces 44. With the erected pieces 44 in contact with the lower end surfaces of mating grooves 56, the erected pieces 44 are pushed from below against and connected to the shield portion configured from the spiral shield 31*c* and the aluminum tape 31*d* of the high-speed wire 31. On the upper surface of the erected pieces 44 are desirably provided recesses or projections that suit the outer diameter of the shield portion in order to increase the contact surface with the shield portion of the high-speed wire 31.

The contact position between the erected pieces 44 and the shield portion of the high-speed wires 31 should be as close as possible to the exposed position of the conductor 31*a* of the high-speed wire 31 connected at the connection terminals 38, for example. This can prevent an impedance mismatch and provide an improved transmission performance.

As described above, the shield member 43 for the single shield wires may be separated from the shield shell 42 or may also be integrated with the shield shell 42.

The attachment piece 47 provided integrally with the shield shell 42 is electrically connected to and then mechanically fixedly, tightly wound around the braided shield 36*a* portion turned up on the outer circumference of the reinforcement ring 29 at an end of the electrical shield wire 30.

With the electrical shield wire 30 fixedly attached to the shield shell 42, the front holder 40 is fixedly inserted into a receiving groove 58 of an outer housing 41. In this case, the front-end surface of the front holder 40 and the front-end surface of the outer housing 41 are flush with each other.

When the cable jack 48 assembled in this manner is fitted over a board-side plug 49, connection pins 50 protruded from the board-side plug 49 are fitted into the connection terminals 38 of the cable jack 48 so as to be drawn to signal terminals 51. Furthermore, an electrically conductive box 59 of the outer circumference of the board-side plug 49 is brought into contact with the outer circumferential surface of the shield shell 42 of the cable jack 48 and drawn to outside from a ground terminal 52 of the board-side plug 49.

When the cable jack 48 and the board-side plug 49 are mated with each other and incorporated into a PC board or the like, the signal terminals 51 are coupled to signal lines, and the ground terminal 52 is coupled to a ground line.

In the shield connector configured as described above, the high-speed wire 31 exposed from the electrical shield wire 30 is configured such that at the exposed portion the high-speed wire 31, the shield portion of a single shield wire configured from the spiral shield portion 31*c* and the aluminum tape 31*d* of the high-speed wire 31 and the erected piece 44 are connected to each other so as to implement impedance matching in the entire region of the exposed portion for connection processing. It is also possible to enhance shield effects.

[Second Embodiment]

Figure 1B:
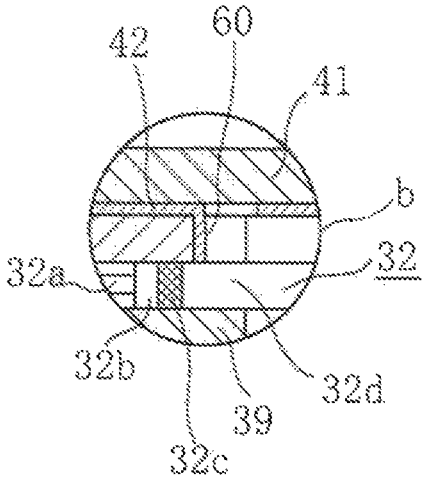
FIG. 1B is a cross-sectional view illustrating a second embodiment of the present invention.

In the embodiment described above, concerning the high-speed wire 31 for differential signal transmission, the erected pieces 44 were provided to implement impedance matching in the entire region of the exposed portion. It is also possible to implement the same configuration for the middle-speed wire 32. Thus, as illustrated in part (b) of FIG. 1B, that corresponds to part "a" of FIG. 1A, part of the shield shell 42 may be notched downwardly and employed as an erected piece 60 for a connector shield member, and the erected piece 60 may be bonded under pressure to a single wire shield portion configured from the spiral shield portion 32*c* and the aluminum tape 32*d* of the middle-speed wire 32, thereby implementing impedance matching in the entire region of the exposed portion of the middle-speed wire 32 and providing improved shield effects.

In the embodiment described above, the single wire shield portions of the high-speed wires 31 were connected to the erected pieces 44 and/or the single wire shield portions of the middle-speed wires 32 were connected to the erected piece 60 by pushing one against the other due to the outstanding ease of the processing. However, without being limited thereto, it is possible to select, depending on the purpose, any one of a swaging structure, a soldering structure, and a sandwiching method.

REFERENCE SIGNS LIST

10 electrical shield wire
11 shield connector
12 male terminal
13 inner housing
14 front holder
15 shield shell
16 shell cover
17 outer housing
18 sheath portion
19 barrel portion
20 single shield wire
21 shield foil
22 crimp portion
23 shield portion

29 reinforcement ring
30 electrical shield wire
31 single shield wire (high-speed wire)
31*a*contuctor
31*b*insulator
31*c*spiral shield
31*d*shield portion
32 single shield wire (middle-speed wire)
32*a*conductor
32*b*insulator
32*c*spiral shield
32*d*shield portion
33 power supply line
33*a*center conductor
33*b*insulator
34 drain wire
35 inner shield portion
35*a*insulation tape
35*b*aluminum tape
36 electrical wire shield portion
36*a*braided shield
36*b*aluminum tape
37 sheath portion
38 connection terminal
39 inner housing
40 front holder
41 outer housing
42 shield shell
43 connector shield member
44 erected piece
45 crimp portion
46 conductive protective member
47 attachment piece
48 cable jack
49 board-side plug
50 connection pin
51 signal terminal
52 ground terminal
53 notch
54 lower groove
55 upper groove
56 mating groove
57 pin hole
58 receiving groove
59 electrically conductive box
60 erected piece

The invention claimed is:

1. A shield connector comprising:

an electrical shield wire having a plurality of single shield wires each constituted of a conductor as a core and a single wire shield portion, and an electrical wire shield portion with which a plurality of electric wires including the plurality of single shield wires are covered and which is partly removed at an end thereof to expose the plurality of single shield wires at ends thereof;

connection terminals connected to respective ones of the conductors of the plurality of exposed single shield wires at the ends thereof;

an inner housing configured to hold the connection terminals;

a shield shell configured to sheath the inner housing and the plurality of exposed shield single wires; and an attachment piece which is integrated with the shield shell and fixedly attached to the end of the electrical shield wire, wherein the shield connector includes a connector shield member provided to the shield shell and electrically connected individually to each of the single wire shield portions of each of the plurality of exposed single shield wires.

2. The shield connector according to claim 1, wherein a position of each electrical connection between the connector shield member and each of the single wire shield portions of each of the plurality of exposed single shield wires is made adjacent to the respective connection terminals at respective positions at which the conductors of each of the plurality of single shield wires are exposed.

3. The shield connector according to claim 1, wherein an erected piece of the connector shield member is bonded under pressure and electrically connected to each of the single wire shield portions of each of the plurality of exposed single shield wires.

4. The shield connector according to claim 1, wherein the electrical shield wire is configured such that high-speed wires configured from a first sub-plurality of the plurality of single shield wires and one drain wire are surrounded by an inner shield portion;

middle-speed wires configured from a second sub-plurality of the plurality of single shield wires and two power supply lines are disposed on an outer circumference of the inner shield portion; and an entirety thereof is sheathed with the electrical wire shield portion and a sheath portion.

5. The shield connector according to claim 4, wherein the connector shield member that is electrically connected to the single wire shield portions of the high-speed wires configured from the plurality of exposed single shield wires is provided to face to the single wire shield portions.

6. The shield connector according to claim 4, wherein the connector shield member that is electrically connected to the single wire shield portions of the high-speed wires configured from the plurality of exposed single shield wires and the single wire shield portions of the middle-speed wires configured from the plurality of exposed single shield wires is provided to face to the single wire shield portions of the high-speed wires and the middle speed wires.

7. The shield connector according to claim 4, wherein the plurality of high-speed wires is configured from differential signal transmission signal lines.

8. A method for connecting a shield connector, the method comprising:

removing an electrical wire shield portion at an end of an electrical shield wire to expose a plurality of single shield wires;

connecting each of a plurality of connection terminals to a conductor at an end of each of the exposed plurality of single shield wires;

holding the plurality of connection terminals in an inner housing;

sheathing the inner housing and the plurality of single shield wires with a shield shell; and fixedly attaching an attachment piece integrated with the shield shell to the end of the electrical shield wire, wherein the shield shell is provided with a connector shield member, and the connector shield member is pushed against single wire shield portions of each of the exposed plurality of single shield wires for individual electrical connection to each by swaging, soldering or sandwiching.

* * * * *